US010502461B2

(12) United States Patent
Christensen et al.

(10) Patent No.: US 10,502,461 B2
(45) Date of Patent: Dec. 10, 2019

(54) $CO_2$ REFRIGERATION SYSTEM WITH DIRECT $CO_2$ HEAT EXCHANGE FOR BUILDING TEMPERATURE CONTROL

(71) Applicant: Hill Phoenix, Inc., Conyers, GA (US)

(72) Inventors: Kim Christensen, Aarhus (DK); Paul Hallett, Conyers, GA (US); Tony Mills, Conyers, GA (US)

(73) Assignee: Hill Phoeniz, Inc., Conyers, GA (US)

( * ) Notice: Subject to any disclaimer, the term of this patent is extended or adjusted under 35 U.S.C. 154(b) by 84 days.

(21) Appl. No.: 15/747,182

(22) PCT Filed: Jul. 27, 2016

(86) PCT No.: PCT/US2016/044164
§ 371 (c)(1),
(2) Date: Jan. 24, 2018

(87) PCT Pub. No.: WO2017/023632
PCT Pub. Date: Feb. 9, 2017

(65) Prior Publication Data

US 2018/0216851 A1 Aug. 2, 2018

Related U.S. Application Data

(60) Provisional application No. 62/286,625, filed on Jan. 25, 2016, provisional application No. 62/200,496, filed on Aug. 3, 2015.

(51) Int. Cl.
*F25B 9/00* (2006.01)
*F25B 49/02* (2006.01)
(Continued)

(52) U.S. Cl.
CPC ..... *F25B 9/008* (2013.01); *F25B 1/10* (2013.01); *F25B 5/00* (2013.01); *F25B 6/00* (2013.01);
(Continued)

(58) Field of Classification Search
CPC .... F25B 9/008; F25B 1/10; F25B 5/00; F25B 6/00; F25B 41/04
See application file for complete search history.

(56) References Cited

U.S. PATENT DOCUMENTS 5,425,246 A * 6/1995 Bessler ..... F25B 41/062 62/211
2003/0182961 A1* 10/2003 Nishida ..... B60H 1/00921 62/324.1
(Continued)

FOREIGN PATENT DOCUMENTS

WO WO-2014/068967 5/2014
WO WO-2014068967 A1 * 5/2014 ..... F25B 9/008
WO WO 2015/111379 7/2015

OTHER PUBLICATIONS

Supplementary European Search Report and Search Opinion regarding European Application No. 16833538.8, dated Feb. 22, 2019, 12 pps.
(Continued)

*Primary Examiner* — Frantz F Jules
*Assistant Examiner* — Lionel Nouketcha
(74) *Attorney, Agent, or Firm* — Foley & Lardner LLP

(57) ABSTRACT

A $CO_2$ refrigeration system includes a $CO_2$ refrigeration subsystem that provides cooling for a refrigeration load using carbon dioxide ($CO_2$) as a refrigerant. The $CO_2$ refrigeration system further includes a direct $CO_2$ heat exchange subsystem that uses the $CO_2$ refrigerant from the $CO_2$ refrigeration subsystem to provide heating or cooling for a building zone. The direct $CO_2$ heat exchange subsystem includes a heat exchanger that exchanges heat directly between the $CO_2$ refrigerant and an airflow provided to the building zone.

19 Claims, 9 Drawing Sheets

(51) Int. Cl.

| | |
|---|---|
| ***F25B 1/10*** | (2006.01) |
| ***F25B 41/04*** | (2006.01) |
| ***F25B 5/00*** | (2006.01) |
| ***F25B 6/00*** | (2006.01) |

(52) U.S. Cl.
CPC ..... *F25B 41/04* (2013.01); *F25B 49/02* (2013.01); *F25B 2400/0401* (2013.01); *F25B 2400/0403* (2013.01); *F25B 2400/0411* (2013.01); *F25B 2400/075* (2013.01); *F25B 2400/13* (2013.01); *F25B 2400/22* (2013.01); *F25B 2400/23* (2013.01); *F25B 2600/21* (2013.01); *F25B 2600/2501* (2013.01); *F25B 2600/2509* (2013.01); *F25B 2600/2513* (2013.01); *F25B 2700/195* (2013.01); *F25B 2700/2104* (2013.01); *F25B 2700/21162* (2013.01); *F25B 2700/21163* (2013.01); *F25B 2700/21174* (2013.01); *F25B 2700/21175* (2013.01)

(56) References Cited

U.S. PATENT DOCUMENTS

| | | | | |
|---|---|---|---|---|
| 2004/0255602 | A1 | 12/2004 | Sato | |
| 2009/0260389 | A1 | 10/2009 | Dube | |
| 2012/0000237 | A1 | 1/2012 | Yamada et al. | |
| 2012/0011866 | A1* | 1/2012 | Scarcella | F25B 1/10 62/79 |
| 2012/0192579 | A1* | 8/2012 | Huff | B60H 1/3232 62/115 |
| 2013/0298593 | A1* | 11/2013 | Christensen | F25B 9/008 62/467 |
| 2014/0352343 | A1* | 12/2014 | Hinde | F25B 1/10 62/277 |
| 2015/0052927 | A1* | 2/2015 | Yang | F25B 1/10 62/238.7 |
| 2015/0128628 | A1 | 5/2015 | Kawagoe et al. | |
| 2016/0102901 | A1* | 4/2016 | Christensen | F25B 9/008 62/117 |

OTHER PUBLICATIONS

International Preliminary Report on Patentability regarding Int'l Application No. PCT/US2016/044164, dated Feb. 6, 2018, 6 pps.
International Search Report and Written Opinion regarding International Application No. PCT/US2016/044164, dated Oct. 21, 2016, 13 pps.

* cited by examiner

$CO_2$ REFRIGERATION SYSTEM WITH DIRECT $CO_2$ HEAT EXCHANGE FOR BUILDING TEMPERATURE CONTROL

CROSS-REFERENCE TO RELATED APPLICATIONS

This Application is a 371 National Stage Application of PCT/US2016/044164, filed on Jul. 27, 2016, which claims the benefit of priority to U.S. Application No. 62/286,625 filed on Jan. 25, 2016 and U.S. Application No. 62/200,496, filed on Aug. 3, 2015, the entire disclosures of which are hereby incorporated by reference for all purposes in their entirety as if fully set forth herein.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this Application and is not admitted to be prior art by inclusion in this section.

The present description relates generally to a refrigeration system primarily using carbon dioxide (i.e., $CO_2$) as a refrigerant. The present description relates more particularly to a $CO_2$ refrigeration system with a direct $CO_2$ heat exchange subsystem for heating and/or cooling a building or building zone.

Refrigeration systems are often used to provide cooling to temperature controlled display devices (e.g. cases, merchandisers, etc.) in supermarkets and other similar facilities. Vapor compression refrigeration systems are a type of refrigeration system which provides such cooling by circulating a fluid refrigerant (e.g., a liquid and/or vapor) through a thermodynamic vapor compression cycle. In a vapor compression cycle, the refrigerant is typically (1) compressed to a high temperature high pressure state (e.g., by a compressor of the refrigeration system), (2) cooled/condensed to a lower temperature state (e.g., in a gas cooler or condenser which absorbs heat from the refrigerant), (3) expanded to a lower pressure (e.g., through an expansion valve), and (4) evaporated to provide cooling by absorbing heat into the refrigerant.

$CO_2$ refrigeration systems are a type of vapor compression refrigeration system that use $CO_2$ as a refrigerant. It is difficult and challenging to adapt a $CO_2$ refrigeration system to also provide heating or cooling for a building space. Typically, the $CO_2$ refrigeration system is used to heat or cool an intermediate heat transfer fluid (e.g., water) which is circulated to the building and used to provide heating or cooling for air within the building space.

SUMMARY

One implementation of the present disclosure is a $CO_2$ refrigeration system. The $CO_2$ refrigeration system includes a $CO_2$ refrigeration subsystem that provides cooling for a refrigeration load using carbon dioxide ($CO_2$) as a refrigerant. The $CO_2$ refrigeration system further includes a direct $CO_2$ heat exchange subsystem that uses the $CO_2$ refrigerant from the $CO_2$ refrigeration subsystem to provide heating or cooling for a building zone. The direct $CO_2$ heat exchange subsystem includes a heat exchanger that exchanges heat directly between the $CO_2$ refrigerant and an airflow provided to the building zone.

In some embodiments, the $CO_2$ refrigeration system includes a gas cooler/condenser that cools the $CO_2$ refrigerant and discharges the cooled $CO_2$ refrigerant into a cooled refrigerant line. The direct $CO_2$ heat exchange subsystem may receive the cooled $CO_2$ refrigerant from the cooled refrigerant line and deliver the cooled $CO_2$ refrigerant to the heat exchanger to provide cooling for the building zone.

In some embodiments, the direct $CO_2$ heat exchange subsystem includes a cooled refrigerant intake line connecting the cooled refrigerant line to the heat exchanger and an expansion valve located along the cooled refrigerant intake line upstream of the heat exchanger.

In some embodiments, the $CO_2$ refrigeration system includes a controller configured to operate the expansion valve to control an amount of the cooled $CO_2$ refrigerant provided to the heat exchanger. In some embodiments, the controller monitors a temperature of the building zone and operates the expansion valve based on the temperature of the building zone. In some embodiments, the controller determines an amount of superheat of the cooled $CO_2$ refrigerant and operates the expansion valve based on the determined amount of superheat.

In some embodiments, the $CO_2$ refrigeration system includes a high pressure valve that receives the cooled $CO_2$ refrigerant from the cooled refrigerant line, expands the cooled $CO_2$ refrigerant, and discharges the expanded $CO_2$ refrigerant into an expanded refrigerant line. The controller may monitor a position of the high pressure valve and operate the expansion valve based on the position of the high pressure valve.

In some embodiments, the direct $CO_2$ heat exchange subsystem includes a discharge line that receives the $CO_2$ refrigerant from the heat exchanger and discharges the $CO_2$ refrigerant into the expanded refrigerant line. In some embodiments, the expanded refrigerant line connects the high pressure valve to a receiver that separates the expanded $CO_2$ refrigerant into a liquid $CO_2$ refrigerant and a gas $CO_2$ refrigerant.

In some embodiments, the $CO_2$ refrigeration subsystem includes a compressor that compresses the $CO_2$ refrigerant to a high temperature high pressure state and discharges the hot compressed refrigerant into a hot compressed refrigerant line. The direct $CO_2$ heat exchange subsystem may receive the hot compressed $CO_2$ refrigerant from the hot compressed refrigerant line and deliver the hot compressed $CO_2$ refrigerant to the heat exchanger to provide heating for the building zone.

In some embodiments, the direct $CO_2$ heat exchange subsystem includes a hot refrigerant intake line that receives the hot compressed $CO_2$ refrigerant from the hot compressed refrigerant line and provides the hot compressed $CO_2$ refrigerant to the heat exchanger. The direct $CO_2$ heat exchange subsystem may further include a hot refrigerant discharge line that receives the $CO_2$ refrigerant from the heat exchanger and provides the $CO_2$ refrigerant to the hot compressed refrigerant line.

In some embodiments, the direct $CO_2$ heat exchange subsystem includes a control valve operable to control an amount of the hot compressed $CO_2$ refrigerant provided to the heat exchanger. In some embodiments, the control valve is a three-way valve that receives the hot compressed $CO_2$ refrigerant from the hot refrigerant intake line and directs the hot compressed $CO_2$ refrigerant to either the heat exchanger or the hot refrigerant discharge line based on a position of the control valve.

In some embodiments, the $CO_2$ refrigeration system includes a controller configured to operate the control valve to control an amount of the hot compressed $CO_2$ refrigerant provided to the heat exchanger. In some embodiments, the controller monitors a temperature of the building zone and operates the control valve based on the temperature of the building zone. In some embodiments, the controller determines a difference between a temperature of the hot compressed $CO_2$ refrigerant and the temperature of the building zone and operates the control valve based on the difference.

Another implementation of the present disclosure is a $CO_2$ cooling system for a building. The $CO_2$ cooling system includes a $CO_2$ refrigeration subsystem that provides cooling for a refrigeration load using carbon dioxide ($CO_2$) as a refrigerant. The $CO_2$ cooling system further includes a gas cooler/condenser that cools the $CO_2$ refrigerant and discharges the cooled $CO_2$ refrigerant into a cooled refrigerant line. The $CO_2$ cooling system further includes a heat exchanger that receives the cooled $CO_2$ refrigerant from the cooled refrigerant line and exchanges heat directly between the cooled $CO_2$ refrigerant and an airflow provided to the building zone.

In some embodiments, the $CO_2$ cooling system includes a high pressure valve that receives the cooled $CO_2$ refrigerant from the cooled refrigerant line, expands the cooled $CO_2$ refrigerant, and discharges the expanded $CO_2$ refrigerant into an expanded refrigerant line. The heat exchanger may discharge the $CO_2$ refrigerant into the expanded refrigerant line.

Another implementation of the present disclosure is a $CO_2$ heating system for a building. The $CO_2$ heating system includes a $CO_2$ refrigeration subsystem that provides cooling for a refrigeration load using carbon dioxide ($CO_2$) as a refrigerant. The $CO_2$ heating system further includes a compressor that compresses the $CO_2$ refrigerant to a high temperature high pressure state and discharges the hot compressed refrigerant into a hot compressed refrigerant line. The $CO_2$ heating system further includes a heat exchanger that receives the hot compressed $CO_2$ refrigerant from the hot compressed refrigerant line and exchanges heat directly between the hot compressed $CO_2$ refrigerant and airflow provided to the building zone.

In some embodiments, the $CO_2$ heating system includes a hot refrigerant discharge line that receives the $CO_2$ refrigerant from the heat exchanger and provides the $CO_2$ refrigerant to the hot compressed refrigerant line.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a $CO_2$ refrigeration system with a direct $CO_2$ heat exchange subsystem is shown, according to various exemplary embodiments. The $CO_2$ refrigeration system may be a vapor compression refrigeration system which uses primarily carbon dioxide (i.e., $CO_2$) as a refrigerant. In some implementations, the $CO_2$ refrigeration system is used to provide cooling for temperature controlled display devices in a supermarket or other similar facility.

The $CO_2$ refrigeration system includes a direct $CO_2$ heat exchange subsystem. The direct $CO_2$ heat exchange subsystem uses a heated or cooled $CO_2$ refrigerant from the $CO_2$ refrigeration system to provide heating and/or cooling for a building or building zone. For example, the direct $CO_2$ heat exchange subsystem may extract a cooled $CO_2$ refrigerant downstream of a gas cooler/condenser of the $CO_2$ refrigeration system (e.g., between the gas cooler/condenser and a high pressure expansion valve). The cooled $CO_2$ refrigerant may be used to provide cooling for the building zone. The direct $CO_2$ heat exchange subsystem may extract a hot compressed $CO_2$ refrigerant downstream of a compressor of the $CO_2$ refrigeration system (e.g., between the compressor and the gas cooler/condenser). The hot compressed $CO_2$ refrigerant may be used to provide heating for the building zone Advantageously, the direct $CO_2$ heat exchange subsystem may place the $CO_2$ refrigerant in a direct heat exchange relationship with air provided to the building zone. For example, the direct $CO_2$ heat exchange subsystem may include a set of heat exchangers that receive the $CO_2$ refrigerant from the $CO_2$ refrigeration system. In some embodiments, the heat exchangers are cassette heat exchangers and may be installed within a wall or ceiling of the building zone. The heat exchangers may include fans configured to force air from the building zone through the heat exchangers. The forced air exchanges heat directly with the $CO_2$ refrigerant passing through the heat exchangers (e.g., without an intermediate heat transfer medium), thereby heating and/or cooling the air. The forced air is then delivered to the building zone to provide heating and/or cooling for the building zone.

$CO_2$ Refrigeration System

Figure 1:
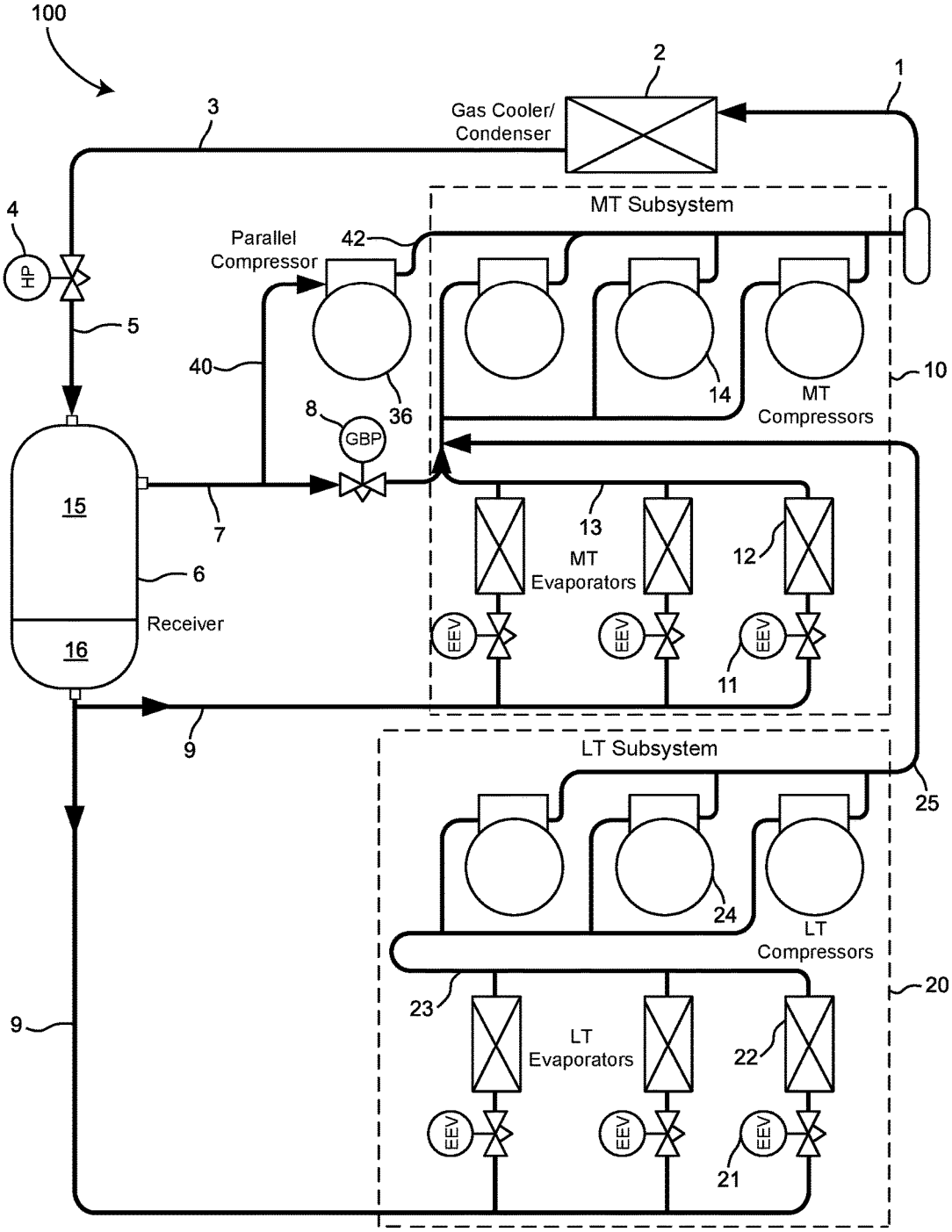
FIG. 1 is a diagram of a $CO_2$ refrigeration system that provides cooling for a refrigeration load using carbon dioxide ($CO_2$) as a refrigerant, according to an exemplary embodiment.

Referring now to FIG. 1, a $CO_2$ refrigeration system 100 is shown according to an exemplary embodiment. $CO_2$ refrigeration system 100 may be a vapor compression refrigeration system which uses primarily carbon dioxide ($CO_2$) as a refrigerant. $CO_2$ refrigeration system 100 and is shown to include a system of pipes, conduits, or other fluid channels (e.g., fluid conduits 1, 3, 5, 7, and 9) for transporting the $CO_2$ refrigerant between various thermodynamic components of $CO_2$ refrigeration system 100. The thermodynamic components of $CO_2$ refrigeration system 100 are shown to include a gas cooler/condenser 2, a high pressure valve 4, a receiver 6, a gas bypass valve 8, a medium-temperature ("MT") subsystem 10, and a low-temperature ("LT") subsystem 20.

Gas cooler/condenser 2 may be a heat exchanger or other similar device for removing heat from the $CO_2$ refrigerant. Gas cooler/condenser 2 is shown receiving $CO_2$ vapor from fluid conduit 1. In some embodiments, the $CO_2$ vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other embodiments, gas cooler/condenser 2 may cool the $CO_2$ vapor (e.g., by removing superheat) without condensing the $CO_2$ vapor into $CO_2$ liquid (e.g., if system operation is in a supercritical region). In some embodiments, the cooling/condensation process is an isobaric process. Gas cooler/condenser 2 is shown outputting the cooled and/or condensed $CO_2$ refrigerant into fluid conduit 3.

High pressure valve 4 receives the cooled and/or condensed $CO_2$ refrigerant from fluid conduit 3 and outputs the $CO_2$ refrigerant to fluid conduit 5. High pressure valve 4 may control the pressure of the $CO_2$ refrigerant in gas cooler/condenser 2 by controlling an amount of $CO_2$ refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the $CO_2$ refrigerant to expand to a lower pressure state. The expansion process may be an isenthalpic and/or adiabatic expansion process, resulting in a flash evaporation of the high pressure $CO_2$ refrigerant to a lower pressure, lower temperature state. The expansion process may produce a liquid/vapor mixture (e.g., having a thermodynamic quality between 0 and 1). In some embodiments, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiver 6.

Receiver 6 collects the $CO_2$ refrigerant from fluid conduit 5. In some embodiments, receiver 6 may be a flash tank or other fluid reservoir. Receiver 6 includes a $CO_2$ liquid portion 16 and a $CO_2$ vapor portion 15 and may contain a partially saturated mixture of $CO_2$ liquid and $CO_2$ vapor. In some embodiments, receiver 6 separates the $CO_2$ liquid from the $CO_2$ vapor. The $CO_2$ liquid may exit receiver 6 through fluid conduits 9. Fluid conduits 9 may be liquid headers leading to MT subsystem 10 and/or LT subsystem 20. The $CO_2$ vapor may exit receiver 6 through fluid conduit 7. Fluid conduit 7 is shown leading the $CO_2$ vapor to a gas bypass valve 8 and a parallel compressor 36 (described in greater detail below).

Still referring to FIG. 1, MT subsystem 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some embodiments, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some embodiments, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one embodiment, the $CO_2$ refrigerant is fully evaporated in MT evaporators 12. In some embodiments, the evaporation process may be an isobaric process. MT evaporators 12 are shown outputting the $CO_2$ refrigerant via fluid conduits 13, leading to MT compressors 14.

MT compressors 14 compress the $CO_2$ refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the $CO_2$ discharge gas exits MT compressors 14 and flows through fluid conduit 1 into gas cooler/condenser 2.

Still referring to FIG. 1, LT subsystem 20 is shown to include one or more expansion valves 21, one or more LT evaporators 22, and one or more LT compressors 24. In various embodiments, any number of expansion valves 21, LT evaporators 22, and LT compressors 24 may be present. In some embodiments, LT subsystem 20 may be omitted and the $CO_2$ refrigeration system 100 may operate with an AC module interfacing with only MT subsystem 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22.

Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some embodiments, expansion valves 21 may expand the $CO_2$ refrigerant to a lower pressure than expansion valves 11, thereby resulting in a lower temperature $CO_2$ refrigerant. Accordingly, LT subsystem 20 may be used in conjunction with a freezer system or other lower temperature display cases.

LT evaporators 22 are shown receiving the cooled and expanded $CO_2$ refrigerant from expansion valves 21. In some embodiments, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some embodiments, the evaporation process may be an isobaric process. LT evaporators 22 are shown outputting the $CO_2$ refrigerant via fluid conduit 23, leading to LT compressors 24.

LT compressors 24 compress the $CO_2$ refrigerant. In some embodiments, LT compressors 24 may compress the $CO_2$ refrigerant to a pressure of approximately 30 bar (e.g., about 425 psig) having a saturation temperature of approximately 23° F. (e.g., about −5° C.). LT compressors 24 are shown outputting the $CO_2$ refrigerant through fluid conduit 25. Fluid conduit 25 may be fluidly connected with the suction (e.g., upstream) side of MT compressors 14.

Still referring to FIG. 1, $CO_2$ refrigeration system 100 is shown to include a gas bypass valve 8. Gas bypass valve 8 may receive the $CO_2$ vapor from fluid conduit 7 and output the $CO_2$ refrigerant to MT subsystem 10. In some embodiments, gas bypass valve 8 is arranged in series with MT compressors 14. In other words, $CO_2$ vapor from receiver 6 may pass through both gas bypass valve 8 and MT compressors 14. MT compressors 14 may compress the $CO_2$ vapor passing through gas bypass valve 8 from a low pressure state (e.g., approximately 30 bar or lower) to a high pressure state (e.g., 45-100 bar).

Gas bypass valve 8 may be operated to regulate or control the pressure within receiver 6 (e.g., by adjusting an amount of $CO_2$ refrigerant permitted to pass through gas bypass valve 8). For example, gas bypass valve 8 may be adjusted (e.g., variably opened or closed) to adjust the mass flow rate, volume flow rate, or other flow rates of the $CO_2$ refrigerant through gas bypass valve 8. Gas bypass valve 8 may be opened and closed (e.g., manually, automatically, by a controller, etc.) as needed to regulate the pressure within receiver 6.

In some embodiments, gas bypass valve 8 includes a sensor for measuring a flow rate (e.g., mass flow, volume flow, etc.) of the $CO_2$ refrigerant through gas bypass valve 8. In other embodiments, gas bypass valve 8 includes an indicator (e.g., a gauge, a dial, etc.) from which the position of gas bypass valve 8 may be determined. This position may be used to determine the flow rate of $CO_2$ refrigerant through gas bypass valve 8, as such quantities may be proportional or otherwise related.

In some embodiments, gas bypass valve 8 may be a thermal expansion valve (e.g., if the pressure on the downstream side of gas bypass valve 8 is lower than the pressure in fluid conduit 7). According to one embodiment, the pressure within receiver 6 is regulated by gas bypass valve 8 to a pressure of approximately 38 bar, which corresponds to about 37° F. Advantageously, this pressure/temperature state may facilitate the use of copper tubing/piping for the downstream $CO_2$ lines of the system. Additionally, this pressure/temperature state may allow such copper tubing to operate in a substantially frost-free manner.

In some embodiments, the $CO_2$ vapor that is bypassed through gas bypass valve 8 is mixed with the $CO_2$ refrigerant gas exiting MT evaporators 12 (e.g., via fluid conduit 13). The bypassed $CO_2$ vapor may also mix with the discharge $CO_2$ refrigerant gas exiting LT compressors 24 (e.g., via fluid conduit 25). The combined $CO_2$ refrigerant gas may be provided to the suction side of MT compressors 14.

In some embodiments, the pressure immediately downstream of gas bypass valve 8 (i.e., in fluid conduit 13) is lower than the pressure immediately upstream of gas bypass valve 8 (i.e., in fluid conduit 7). Therefore, the $CO_2$ vapor passing through gas bypass valve 8 and MT compressors 14 may be expanded (e.g., when passing through gas bypass valve 8) and subsequently recompressed (e.g., by MT compressors 14). This expansion and recompression may occur without any intermediate transfers of heat to or from the $CO_2$ refrigerant, which can be characterized as an inefficient energy usage.

Still referring to FIG. 1, $CO_2$ refrigeration system 100 is shown to include a parallel compressor 36. Parallel compressor 36 may be arranged in parallel with other compressors of $CO_2$ refrigeration system 100 (e.g., MT compressors 14, LT compressors 24, etc.). Although only one parallel compressor 36 is shown, any number of parallel compressors may be present. Parallel compressor 36 may be fluidly connected with receiver 6 and/or fluid conduit 7 via a connecting line 40. Parallel compressor 36 may be used to draw non-condensed $CO_2$ vapor from receiver 6 as a means for pressure control and regulation. Advantageously, using parallel compressor 36 to effectuate pressure control and regulation may provide a more efficient alternative to traditional pressure regulation techniques such as bypassing $CO_2$ vapor through bypass valve 8 to the lower pressure suction side of MT compressors 14.

In some embodiments, parallel compressor 36 may be operated (e.g., by a controller) to achieve a desired pressure within receiver 6. For example, the controller may receive pressure measurements from a pressure sensor monitoring the pressure within receiver 6 and may activate or deactivate parallel compressor 36 based on the pressure measurements. When active, parallel compressor 36 compresses the $CO_2$ vapor received via connecting line 40 and discharges the compressed vapor into connecting line 42. Connecting line 42 may be fluidly connected with fluid conduit 1. Accordingly, parallel compressor 36 may operate in parallel with MT compressors 14 by discharging the compressed $CO_2$ vapor into a shared fluid conduit (e.g., fluid conduit 1).

Parallel compressor 36 may be arranged in parallel with both gas bypass valve 8 and with MT compressors 14. In other words, $CO_2$ vapor exiting receiver 6 may pass through either parallel compressor 36 or the series combination of gas bypass valve 8 and MT compressors 14. Parallel compressor 36 may receive the $CO_2$ vapor at a relatively higher pressure (e.g., from fluid conduit 7) than the $CO_2$ vapor received by MT compressors 14 (e.g., from fluid conduit 13). This differential in pressure may correspond to the pressure differential across gas bypass valve 8. In some embodiments, parallel compressor 36 may require less energy to compress an equivalent amount of $CO_2$ vapor to the high pressure state (e.g., in fluid conduit 1) as a result of the higher pressure of $CO_2$ vapor entering parallel compressor 36. Therefore, the parallel route including parallel compressor 36 may be a more efficient alternative to the route including gas bypass valve 8 and MT compressors 14.

In some embodiments, gas bypass valve 8 is omitted and the pressure within receiver 6 is regulated using parallel compressor 36. In other embodiments, parallel compressor 36 is omitted and the pressure within receiver 6 is regulated using gas bypass valve 8. In other embodiments, both gas bypass valve 8 and parallel compressor 6 are used to regulate the pressure within receiver 6. All such variations are within the scope of the present invention.

Direct $CO_2$ Heat Exchange Subsystem

Figure 3A:
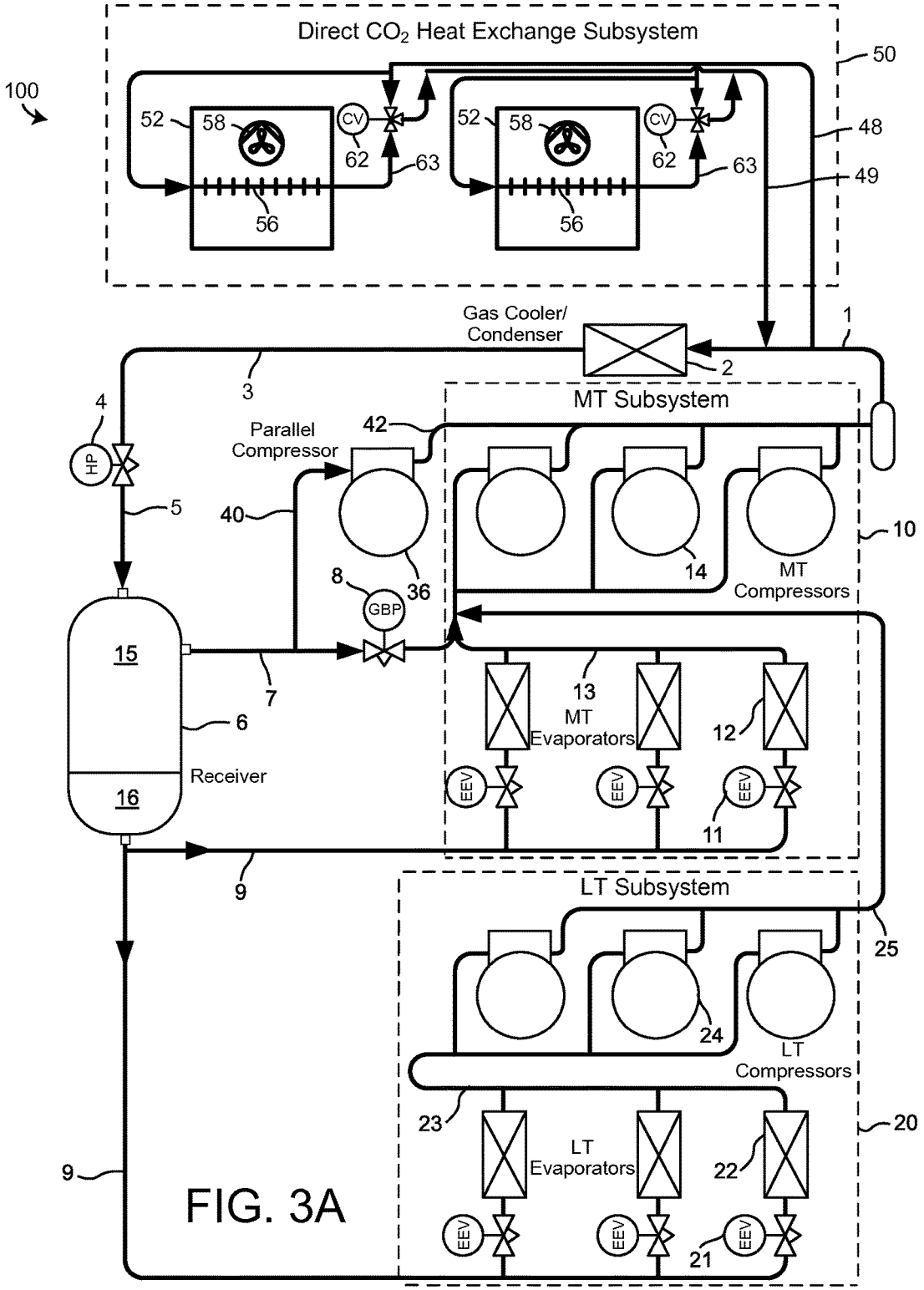
FIG. 3A is a diagram of the $CO_2$ refrigeration system of FIG. 1 with a direct $CO_2$ heat exchange subsystem configured to provide heating for a building zone, according to an exemplary embodiment.
Figure 3B:
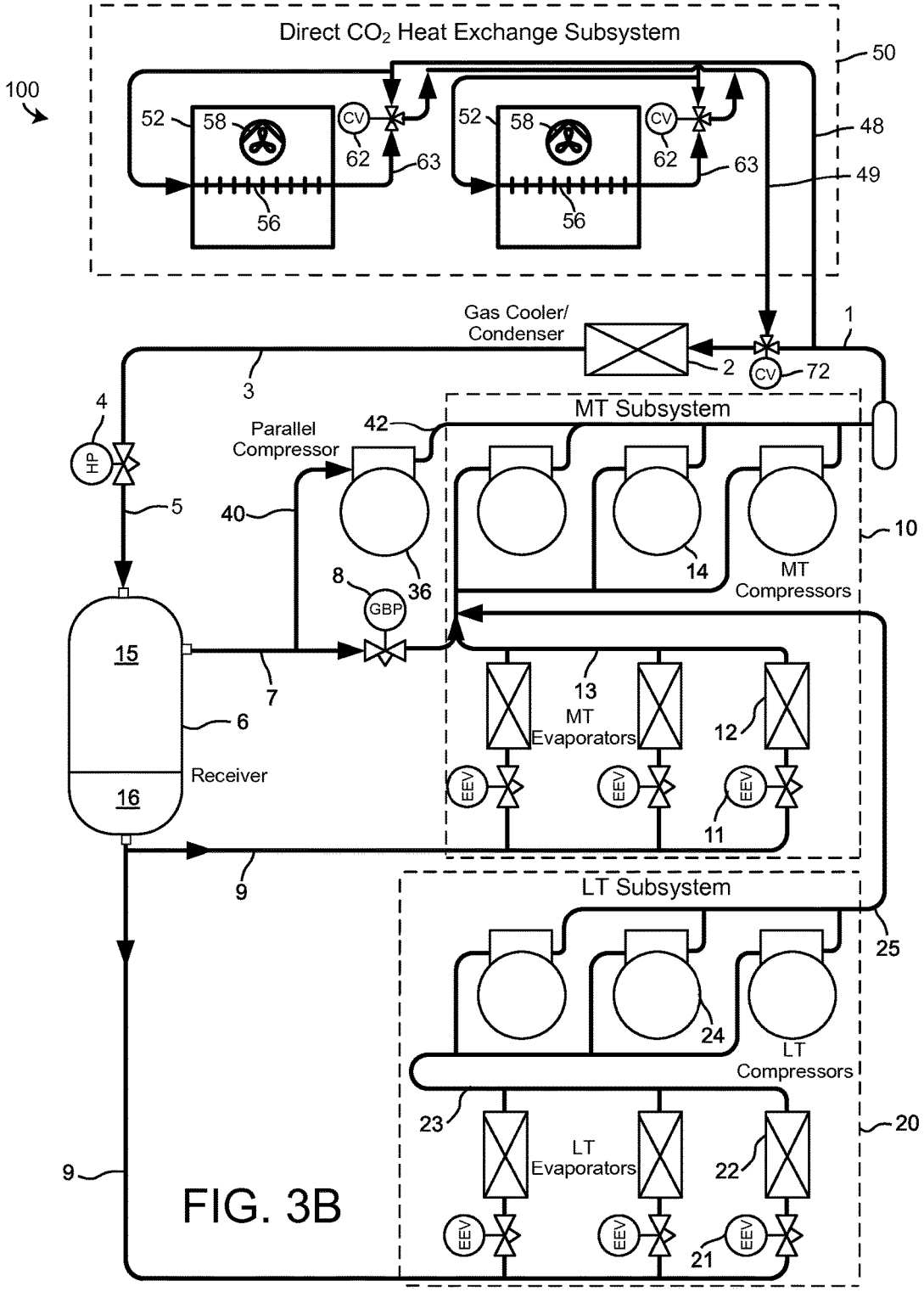
FIG. 3B is a diagram of the $CO_2$ refrigeration system of FIG. 1 with a direct $CO_2$ heat exchange subsystem configured to provide heating for a building zone, according to another exemplary embodiment.
Figure 3C:
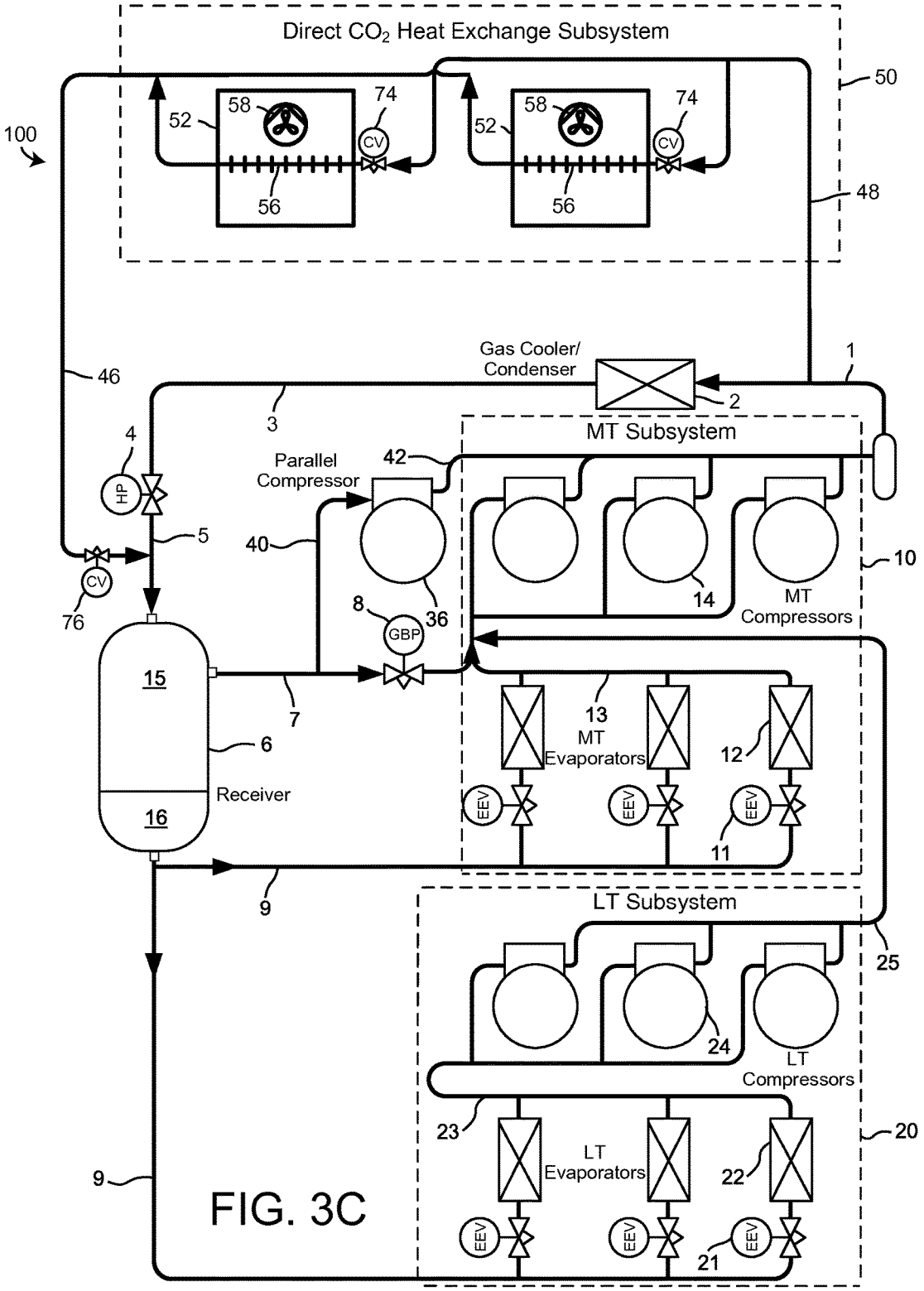
FIG. 3C is a diagram of the $CO_2$ refrigeration system of FIG. 1 with a direct $CO_2$ heat exchange subsystem configured to provide heating for a building zone, according to another exemplary embodiment.
Figure 3D:
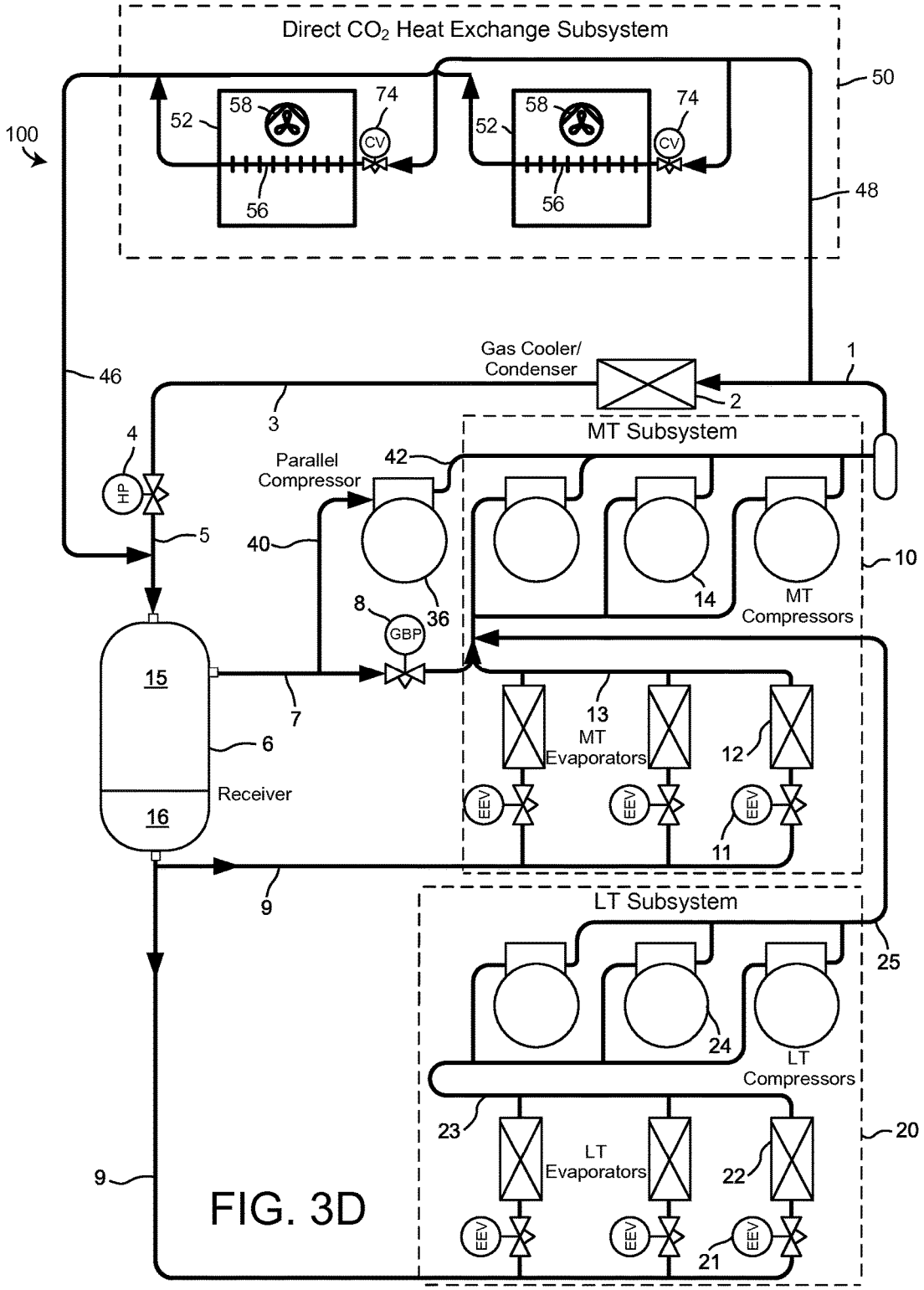
FIG. 3D is a diagram of the $CO_2$ refrigeration system of FIG. 1 with a direct $CO_2$ heat exchange subsystem configured to provide heating for a building zone, according to another exemplary embodiment.
Figure 4:
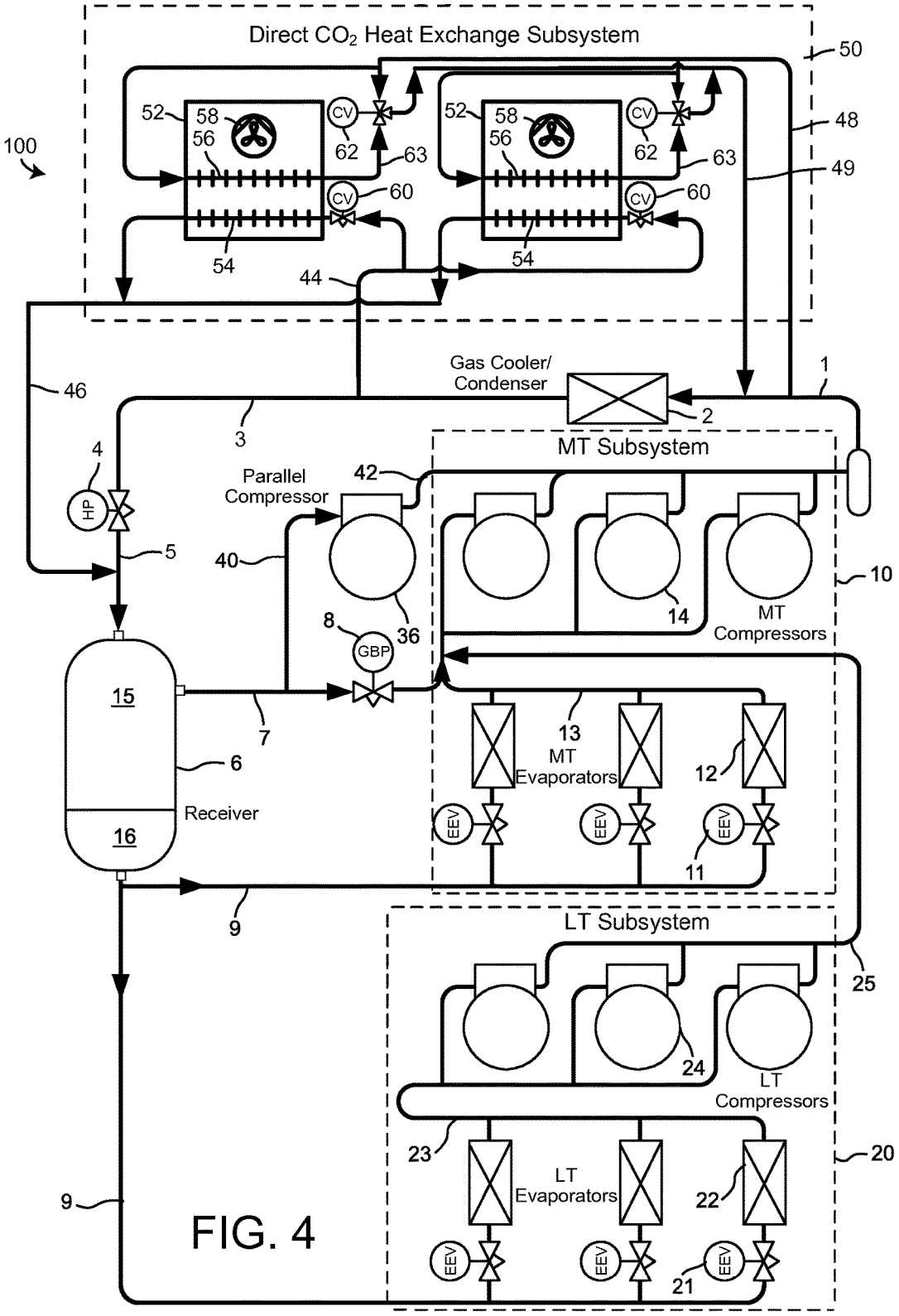
FIG. 4 is a diagram of the $CO_2$ refrigeration system of FIG. 1 with a direct $CO_2$ heat exchange subsystem configured to provide both cooling and heating for a building zone, according to an exemplary embodiment.
Figure 5:
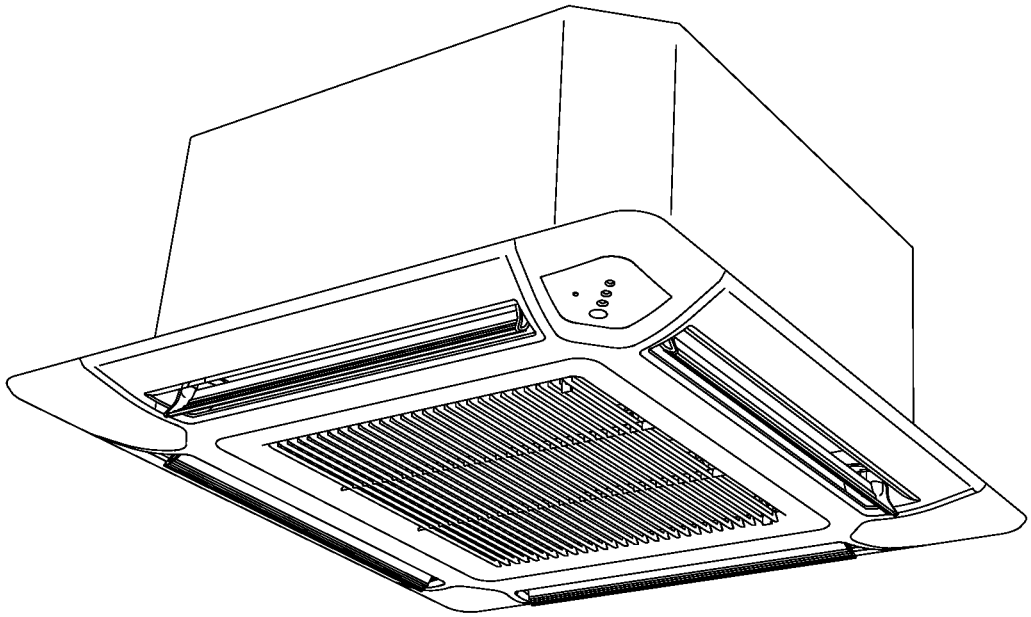
FIG. 5 is a drawing of a cassette heat exchanger which may uses a $CO_2$ refrigerant from the $CO_2$ refrigeration system to provide heating and/or cooling for a building zone, according to an exemplary embodiment.

Referring now to FIGS. 2A-5, $CO_2$ refrigeration system 100 is shown to include a direct $CO_2$ heat exchange subsystem 50. Subsystem 50 may be configured to provide heating and/or cooling for a building or building zone (e.g., a building area, a room, a workspace, etc.) using the $CO_2$ refrigerant from $CO_2$ refrigeration system 100 as a heat transfer medium. Advantageously, subsystem 50 may place the $CO_2$ refrigerant in a direct heat exchange relationship with air provided to the building zone. For example, subsystem 50 is shown to include a set of heat exchangers 52 that receive the $CO_2$ refrigerant from $CO_2$ refrigeration system 100. In some embodiments, heat exchangers 52 are cassette heat exchangers, as shown in FIG. 5. Heat exchangers 52 may be installed within a wall or ceiling of a building zone and may include fans 58 configured to force air from the building zone through heat exchangers 52. In some embodiments, the forced air exchanges heat directly with the $CO_2$ refrigerant passing through heat exchangers 52 (e.g., without an intermediate heat transfer medium), thereby heating and/or cooling the air. The forced air is then delivered to the building zone to provide heating and/or cooling for the building zone.

Figure 2A:
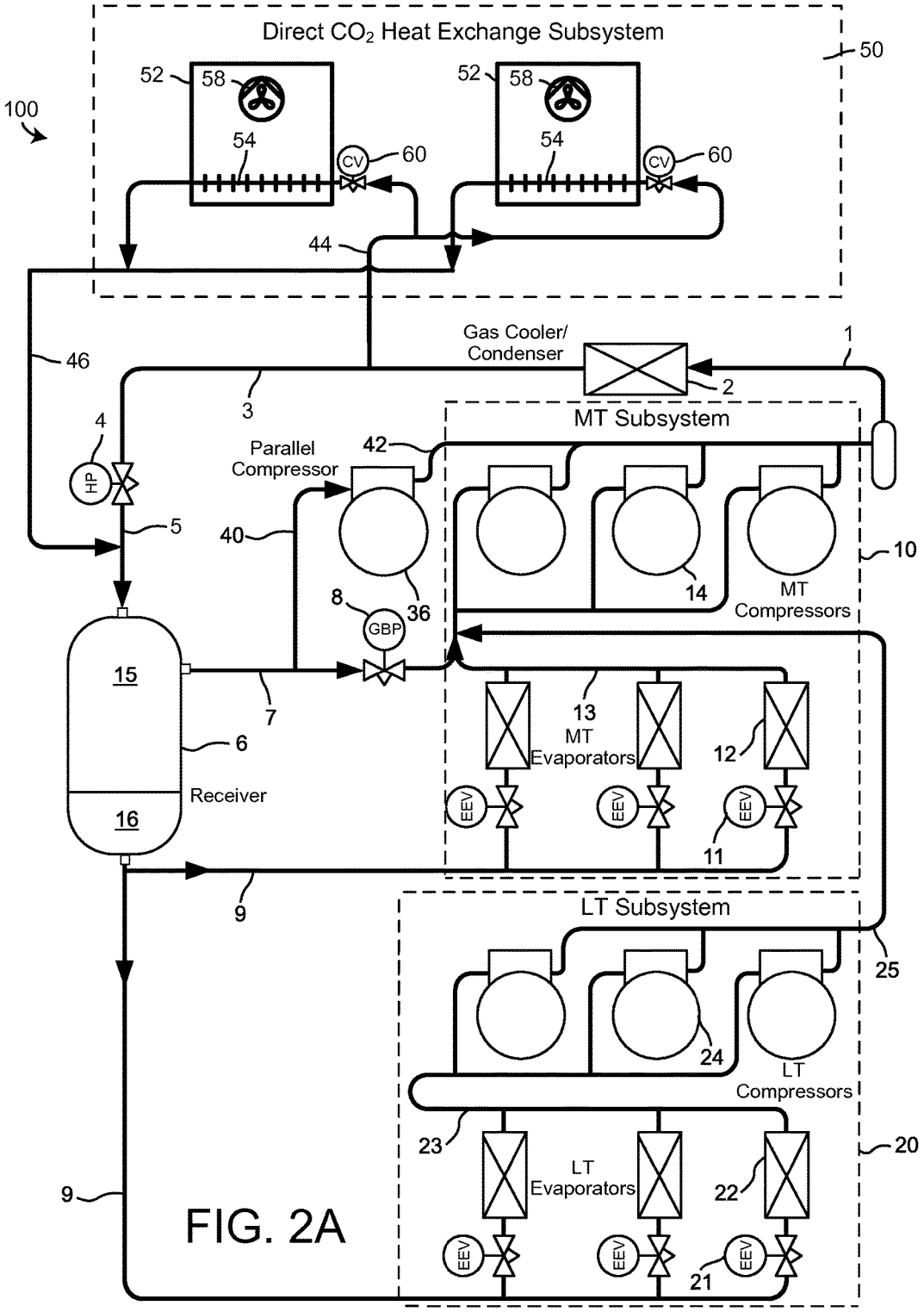
FIG. 2A is a diagram of the $CO_2$ refrigeration system of FIG. 1 with a direct $CO_2$ heat exchange subsystem configured to provide cooling for a building zone, according to an exemplary embodiment.
Figure 2B:
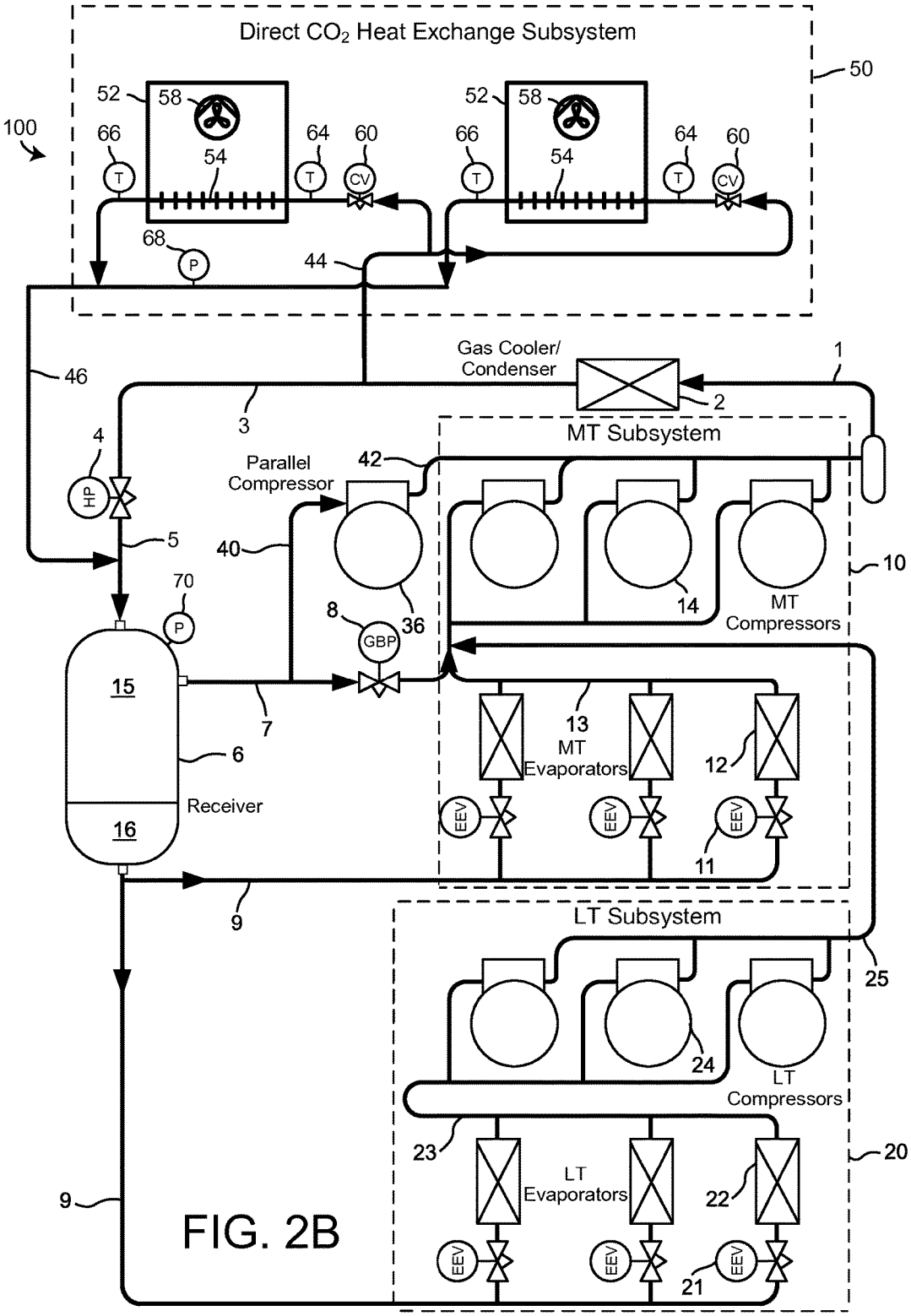
FIG. 2B is a diagram of the $CO_2$ refrigeration system of FIG. 1 with a direct $CO_2$ heat exchange subsystem configured to provide cooling for a building zone, according to another exemplary embodiment.

Referring particularly to FIGS. 2A-2B, direct $CO_2$ heat exchange subsystem 50 may be configured to provide cooling for a building or building zone using the cooled/condensed $CO_2$ refrigerant from $CO_2$ refrigeration system 100. Direct $CO_2$ heat exchange subsystem 50 is shown to include a fluid conduit 44 that receives the high pressure cooled/condensed $CO_2$ refrigerant from gas cooler/condenser 2. Fluid conduit 44 may be connected to fluid conduit 3 and may deliver a portion of the high pressure cooled/condensed $CO_2$ refrigerant from fluid conduit 3 to heat exchangers 52.

In some embodiments, direct $CO_2$ heat exchange subsystem 50 includes one or more expansion valves 60. Expansion valves 60 may be located along fluid conduit 44 upstream of heat exchangers 52. Expansion valves 60 may be control valves (e.g., electronic expansion valves, stepper valves, etc.) or other types of variable-position expansion valves. Expansion valves 60 are shown receiving the $CO_2$ refrigerant from fluid conduit 44 and outputting the $CO_2$ refrigerant to cooling tubes 54 within heat exchangers 52. Expansion valves 60 may cause the $CO_2$ refrigerant to undergo a rapid drop in pressure, thereby expanding the $CO_2$ refrigerant to a lower pressure, lower temperature state.

Fans 58 force air from the building zone through heat exchangers 52. The forced air passes over cooling tubes 54 and transfers heat to the cooler $CO_2$ refrigerant flowing through cooling tubes 54, thereby cooling the air. The cooled air is then delivered to the building zone to provide cooling for the building zone. The $CO_2$ refrigerant flows from cooling tubes 54 into fluid conduit 46. Fluid conduit 46 may connect to $CO_2$ refrigeration system 100 downstream of high pressure valve 4. For example, fluid conduit 46 is shown delivering the $CO_2$ refrigerant from heat exchangers 52 into fluid conduit 5, which connects high pressure valve 4 to receiver 6.

In some embodiments, the injection of the high pressure $CO_2$ refrigerant into heat exchangers 52 is controlled by expansion valves 60. Each of expansion valves 60 may be configured to control the flow rate of $CO_2$ refrigerant through one of heat exchangers 52. In some embodiments, expansion valves 60 are operated automatically by a controller. The controller may monitor the temperature of the building zone (e.g., by receiving a temperature input from a temperature sensor installed within the building zone) and may operate expansion valves 60 based on the temperature of the building zone. In some embodiments, the controller operates expansion valves 60 using on/off control. For example, the controller may cause expansion valves 60 to open when cooling is required (i.e., when the temperature of the building zone is above a temperature setpoint) in order to provide cooling for the building zone. The controller may cause expansion valves 60 to close when cooling is not required (i.e., when the temperature of the building zone is not above the temperature setpoint). In other embodiments, the controller modulates the position of expansion valves 60 between a plurality of positions between fully open and fully closed based on the difference between the building zone temperature and the temperature setpoint. For example, the degree to which the controller opens expansion valves 60 may be based on a difference between the building zone temperature and the temperature setpoint.

In some embodiments, the controller operates expansion valves 60 based on the position (e.g., opening degree) of high pressure valve 4. For example, the controller may monitor the position of high pressure valve 4 and may provide expansion valves with an opening signal based on the position of high pressure valve 4. In some embodiments, the maximum opening signal provided by the controller to expansion valves 60 is limited by the position of high pressure valve 4. In some embodiments, the controller causes expansion valves 60 to open by a greater amount when the position of high pressure valve 4 is relatively more open (e.g., to compensate for a lesser flow rate caused by a lesser pressure differential between fluid conduits 3 and 5) and by a lesser amount when the position of high pressure valve 4 is relatively more closed (e.g., to compensate for a greater flow rate caused by a greater pressure differential between fluid conduits 3 and 5). In other embodiments, the controller causes expansion valves 60 to open by a greater amount when the position of high pressure valve 4 is relatively more closed and by a lesser amount when the position of high pressure valve 4 is relatively more open.

In some embodiments, the controller operates expansion valves 60 based on an amount of superheat of the high pressure $CO_2$ refrigerant received from fluid conduit 3. For example, the controller may monitor the temperature, pressure, and/or other thermodynamic properties of the high pressure $CO_2$ refrigerant output by gas cooler/condenser 2 and may determine an amount of superheat (if any) of the high pressure $CO_2$ refrigerant. In other embodiments, the controller operates expansion valves 60 based on the amount of superheat of the $CO_2$ refrigerant at the outlet of heat exchangers 52. For example, the controller may monitor the temperature, pressure, and/or other thermodynamic properties of the $CO_2$ refrigerant within fluid conduit 46 and may determine an amount of superheat (if any) of the $CO_2$ refrigerant.

In some embodiments, the maximum opening signal provided by the controller to expansion valves 60 is limited by the amount of superheat. In some embodiments, the controller causes expansion valves 60 to open by a greater amount when the amount of superheat is relatively high (e.g., to accommodate less efficient heat transfer into the higher temperature $CO_2$ refrigerant) and by a lesser amount when the amount of superheat is relatively low (e.g., to accommodate more efficient heat transfer into the lower temperature $CO_2$ refrigerant). In other embodiments, the controller causes expansion valves 60 to open by a greater amount when the amount of superheat is relatively low and by a lesser amount when the amount of superheat is relatively high.

Referring particularly to FIG. 2B, direct $CO_2$ heat exchange subsystem 50 may include one or more sensors 64-70 configured to measure various states of the $CO_2$ refrigerant. For example, subsystem 50 is shown to include an inlet temperature sensor 64 and an outlet temperature sensor 66. Inlet temperature sensor 64 may be located at an inlet of heat exchanger 52 (e.g., between expansion valve 60 and cooling tube 54) and configured to measure the temperature of the $CO_2$ refrigerant at the inlet of heat exchanger 52. Outlet temperature sensor 66 may be located at an outlet of heat exchanger 52 (e.g., immediately downstream of cooling tube 54) and configured to measure the temperature of the $CO_2$ refrigerant at the outlet of heat exchanger 52. In some embodiments, each heat exchanger 52 has a separate set of temperature sensors 64-66 configured to measure the temperature of the $CO_2$ refrigerant upstream and downstream of heat exchanger 52 (e.g., one set of sensors 64-66 for each heat exchanger 52).

In some embodiments, the controller determines the amount of superheat based on temperature measurements from inlet temperature sensor 64 and/or outlet temperature sensor 66. For example, the controller may calculate the amount of superheat S by subtracting the inlet temperature $T_{in}$ measured by inlet temperature sensor 64 from the outlet temperature $T_{out}$ measured by outlet temperature sensor 66 (e.g., $S=T_{out}-T_{in}$). This technique for calculating the superheat may be based on an assumption that the $CO_2$ refrigerant is a saturated vapor (or liquid-vapor mixture) at the inlet of heat exchanger 52. Therefore, the heat gain across heat exchanger 52 (i.e., $T_{out}-T_{in}$) may indicate the amount of superheat.

In some embodiments, the controller calculates the amount of superheat using only outlet temperature sensor 66. For example, the controller may calculate superheat S by subtracting a known saturation temperature $T_{sat}$ of the $CO_2$ refrigerant from the outlet temperature $T_{out}$ measured by outlet temperature sensor 66 (e.g., $S=T_{out}-T_{sat}$). This technique for calculating the superheat may be based on an assumption that the $CO_2$ refrigerant is in a saturated state (or a liquid-vapor mixture) prior to absorbing heat in heat exchanger 52. If the pressure within heat exchanger 52 remains substantially constant (i.e., $P_{static}$), the saturation temperature $T_{sat}$ may also remain substantially constant. Accordingly, the saturation temperature $T_{sat}$ can be calculated once based on the static pressure $P_{static}$ (e.g., $T_{sat}=f(P_{static})$ and stored in the memory of the controller.

In some embodiments, subsystem 50 includes a receiver pressure sensor 70. Receiver pressure sensor 70 may be located within receiver 6 (e.g., within vapor portion 15) and configured to measure the pressure of the $CO_2$ refrigerant within receiver 6. The controller may use the receiver pressure $P_{rec}$ measured by receiver pressure sensor 70 to calculate the saturated receiver temperature $T_{sat}$ (e.g., $T_{sat}=f(P_{rec})$. This saturation temperature may be assumed to be the same as the temperature of the $CO_2$ refrigerant upstream of heat exchanger 52, assuming an isobaric heat exchange process. As before, the controller may calculate superheat S by subtracting the saturation temperature $T_{sat}$ of the $CO_2$ refrigerant from the outlet temperature $T_{out}$ measured by outlet temperature sensor 66 (e.g., $S=T_{out}-T_{sat}$). This technique for calculating the superheat may be advantageous when the receiver pressure $P_{rec}$ is variable and cannot be assumed to be a static value.

In some embodiments, subsystem 50 includes an outlet pressure sensor 68. Outlet pressure sensor 68 may be located along fluid conduit 46 (e.g., between heat exchanger 52 and receiver 6) and configured to measure the pressure of the $CO_2$ refrigerant in fluid conduit 46. The pressure measured by outlet pressure sensor 68 may be the same as the pressure of the $CO_2$ refrigerant within heat exchanger 52, assuming an isobaric heat exchange process. Outlet pressure sensor 68 may provide a more accurate indication of the pressure of the $CO_2$ within heat exchanger 52 relative to a pressure sensor located within receiver 6. The controller may use the outlet pressure $P_{out}$ measured by outlet pressure sensor 68 to calculate the saturated evaporation temperature $T_{sat}$ (e.g., $T_{sat}=f(P_{out})$ As before the controller may calculate superheat S by subtracting the saturation temperature $T_{sat}$ of the $CO_2$ refrigerant from the outlet temperature $T_{out}$ measured by outlet temperature sensor 66 (e.g., $S=T_{out}-T_{sat}$).

Referring now to FIGS. 3A-3D, direct $CO_2$ heat exchange subsystem 50 may be configured to provide heating for a building or building zone using the hot compressed $CO_2$ refrigerant from $CO_2$ refrigeration system 100. Direct $CO_2$ heat exchange subsystem 50 is shown to include a fluid conduit 48 that receives the high pressure hot $CO_2$ refrigerant upstream of gas cooler/condenser 2. Fluid conduit 48 may be connected to fluid conduit 1 and may deliver a portion of the high pressure hot $CO_2$ refrigerant from fluid conduit 1 to heating tubes 56 within heat exchangers 52. Fans 58 force air from the building zone through heat exchangers 52. The forced air passes over heating tubes 56 and absorbs heat from the warmer $CO_2$ refrigerant flowing through heating tubes 56, thereby heating the air. The heated air is then delivered to the building zone to provide heating for the building zone.

Referring particularly to FIGS. 3A-3B, the $CO_2$ refrigerant may flow from heating tubes 56 into fluid conduit 63. In some embodiments, fluid conduit 63 connects to control valves 62, which route the $CO_2$ refrigerant from fluid conduit 63 into fluid conduit 49. Fluid conduit 49 connects to $CO_2$ refrigeration system 100 upstream of gas cooler/condenser 2. For example, fluid conduit 49 is shown delivering the $CO_2$ refrigerant from heat exchangers 52 into fluid conduit 1, which connects MT compressors 14 to gas cooler/condenser 2. In other embodiments, fluid conduit 63 connects directly to fluid conduit 1 upstream of gas cooler/condenser 2. In some embodiments, direct $CO_2$ heat exchange subsystem 50 includes one or more pumps positioned along fluid conduit 48 and/or fluid conduit 49 configured to cause the hot compressed $CO_2$ refrigerant to flow through heat exchangers 52.

In some embodiments, fluid conduit 49 connects directly to fluid conduit 1 (as shown in FIG. 3A). In other embodiments, fluid conduit 49 connects to a three-way valve 72 positioned at the intersection of fluid conduit 49 and fluid conduit 1. Three-way valve 72 may be operated (e.g., manually or by a controller) to turn heating on/off. For example, three-way valve 72 may be configured to move into a first position (i.e., a "heating on" position) in which some or all of the $CO_2$ refrigerant from fluid conduit 49 is permitted to flow through three-way valve 72 and into fluid conduit 1. Three-way valve 72 may be configured to move into a second position (i.e., a "heating off" position) in which all of the $CO_2$ refrigerant from fluid conduit 49 is prevented from passing through three-way valve 72. In the heating off position, all of the $CO_2$ refrigerant from fluid conduit 1 may pass directly through three-way valve 72, bypassing heat exchangers 52. In some embodiments, three-way valve 72 has a mechanical endpoint that bleeds excess $CO_2$ refrigerant when three-way valve 72 is in the heating off position. This allows three-way valve 72 to lead only the necessary amount of $CO_2$ refrigerant to heat exchangers 52.

Control valves 62 are shown as three-way valves connecting fluid conduits 48, 49, and 63. Control valves 62 may be configured to route the hot $CO_2$ refrigerant from fluid conduit 48 to either fluid conduit 49 (bypassing heat exchangers 52) or to heat exchangers 52 and into fluid conduit 63. In other words, control valves 62 may control an amount of the hot $CO_2$ refrigerant that passes through heat exchangers 52. Each of control valves 62 may be configured to control a flow rate of the hot $CO_2$ refrigerant through one of heat exchangers 52. Advantageously, the combination of three-way valve 72 and control valves 62 can be used to turn heating on/off across all of heat exchangers 52 (e.g., by operating three-way valve 72) or across each of heat exchangers 52 individually (e.g., by operating individual control valves 62 associated with each heat exchanger 52).

In some embodiments, control valves 62 are operated automatically by a controller. The controller may monitor the temperature of the building zone (e.g., by receiving a temperature input from a temperature sensor installed within the building zone) and may operate control valves 62 based on the temperature of the building zone. For example, the controller may cause control valves 62 to deliver the hot $CO_2$ refrigerant to heat exchangers 52 when heating is required (i.e., when the temperature of the building zone is below a temperature setpoint) in order to provide heating for the building zone. The controller may cause control valves 62 to deliver the hot $CO_2$ refrigerant to fluid conduit 49 (bypassing heat exchangers 52) when heating is not required (i.e., when the temperature of the building zone is not below the temperature setpoint). In some embodiments, control valves 62 have a low flow coefficient and/or a flow reduction on bypass. This allows the control valve 62 for each heat exchanger 52 to match the pressure drop across other heat exchangers 52 when the heat exchanger 52 associated with the control valve 62 is bypassed.

In some embodiments, the controller operates control valves 62 to deliver a first portion of the hot $CO_2$ refrigerant to heat exchangers 52 and a second portion of the hot $CO_2$ refrigerant directly to fluid conduit 49. The relative amounts of the first portion and the second portion may be controlled by the position of control valves 62 based on a control signal from the controller. In some embodiments, the control signal is dependent upon the temperature of the building zone as previously described. For example, the controller may provide control valves 62 with a control signal to deliver the hot $CO_2$ refrigerant to heat exchangers 52 when the temperature of the building zone is below a temperature setpoint, and with a control signal to deliver the hot $CO_2$ refrigerant to fluid conduit 49 when the temperature of the building zone is not below the temperature setpoint.

In some embodiments, the control signal is dependent upon a difference between the temperature of the building zone and the temperature of the hot $CO_2$ refrigerant. For example, the controller may monitor the temperature of the hot $CO_2$ refrigerant upstream of gas cooler/condenser 2 and/or in fluid conduit 48. The controller may compare the temperature of the hot $CO_2$ refrigerant to the temperature of the building zone and generate a control signal for control valves 62 based on a result of the comparison. In some embodiments, the controller causes control valves 62 to deliver the hot $CO_2$ refrigerant to heat exchangers 52 if the temperature of the hot $CO_2$ refrigerant is greater than the temperature of the building zone (e.g., strictly greater or greater by a predetermined amount) and if heating is required for the building zone (e.g., the building zone temperature is less than a temperature setpoint). However, if the temperature of the $CO_2$ refrigerant is not greater than the temperature of the building zone (e.g., strictly greater or greater by the predetermined amount) or if cooling is not required, the controller may operate control valves 62 to deliver the hot $CO_2$ refrigerant to fluid conduit 49 bypassing heat exchangers 52.

In some embodiments, the controller operates high pressure valve 4 to control the pressure lift. The controller may be configured to control the pressure lift based on an external demand (e.g., a digital signal 0-10V) and/or based on internal feedback (e.g. based on the temperature of the $CO_2$ refrigerant in fluid conduit 49). For example, subsystem 50 may include a temperature sensor along fluid conduit 49 configured to measure the common hot gas discharge temperature from heat exchangers 52. The controller may be configured to modulate the position of high pressure valve 3 based on the temperature measurement, thereby controlling pressure lift.

Referring now to FIGS. 3C-3D, another embodiment of direct $CO_2$ heat exchange subsystem 50 is shown. As before, fluid conduit 48 delivers the hot $CO_2$ refrigerant to heat exchangers 52. However, subsystem 50 is shown to include control valves 74 positioned upstream of heating tubes 56. Fluid conduit 48 delivers the hot $CO_2$ refrigerant to control valves 74, which may be operated (e.g., manually or by a controller) to control an amount of the hot $CO_2$ refrigerant permitted to flow through each of heat exchangers 52.

In some embodiments, a controller automatically operates control valves 74 based on the temperature of each building zone. For example, if the temperature of a building zone heated by a particular heat exchanger 52 is below a heating setpoint, the controller may open the corresponding control valve 74 to allow the hot $CO_2$ gas to flow through the heat exchanger 52, thereby providing heating for the building zone. However, if the temperature of the building zone is not below the heating setpoint, the controller may close the corresponding control valve 74 to prevent the hot $CO_2$ gas from flowing through the heat exchanger 52, thereby preventing additional heating for the building zone. Advantageously, the controller may operate each of control valves 74 independently to provide different amounts of heating for each building zone.

In some embodiments, subsystem 50 includes a common heating control valve 76 (shown in FIG. 3C). Control valve 76 may be operated (e.g., manually or by a controller) to turn heating on/off. For example, control valve 76 may be configured to move into a first position (i.e., a "heating on" position) in which some or all of the $CO_2$ refrigerant from fluid conduit 46 is permitted to flow through control valve 76 and into fluid conduit 5. Control valve 76 may be configured to move into a second position (i.e., a "heating off" position) in which all of the $CO_2$ refrigerant from fluid conduit 46 is prevented from passing through control valve 76. In various embodiments, control valve 76 may be located along fluid conduit 46 (as shown in FIG. 3C), along fluid conduit 48, or may be omitted entirely (as shown in FIG. 3D). As before, the controller may operate high pressure valve 4 to control the pressure lift.

Referring now to FIG. 4, direct $CO_2$ heat exchange subsystem 50 may be configured to provide both cooling and heating for a building or building zone using the $CO_2$ refrigerant from $CO_2$ refrigeration system 100. Direct $CO_2$ heat exchange subsystem 50 is shown to include all of the components described with reference to FIGS. 2A and 3A. For example, direct $CO_2$ heat exchange subsystem 50 is shown to include a fluid conduit 44 that receives the high pressure cooled/condensed $CO_2$ refrigerant from gas cooler/condenser 2 and provides the cooled/condensed $CO_2$ refrigerant to cooling tubes 54 within heat exchangers 52. Direct $CO_2$ heat exchange subsystem 50 is also shown to include a fluid conduit 48 that receives the high pressure hot $CO_2$ refrigerant upstream of gas cooler/condenser 2 and provides the high pressure hot $CO_2$ refrigerant to heating tubes 56 within heat exchangers 52. It is contemplated that the embodiment shown in FIG. 4 can be modified to include any combination of components and/or configurations shown in FIGS. 2A-3D. The components shown in FIG. 4 may operate in the same or similar manner as previously described with reference to FIGS. 2A-3D. Advantageously, the arrangement shown in FIG. 4 may allow direct $CO_2$ heat exchange subsystem 50 to provide heating and/or cooling for the building zone.

$CO_2$ Refrigeration System Controller

Figure 6:
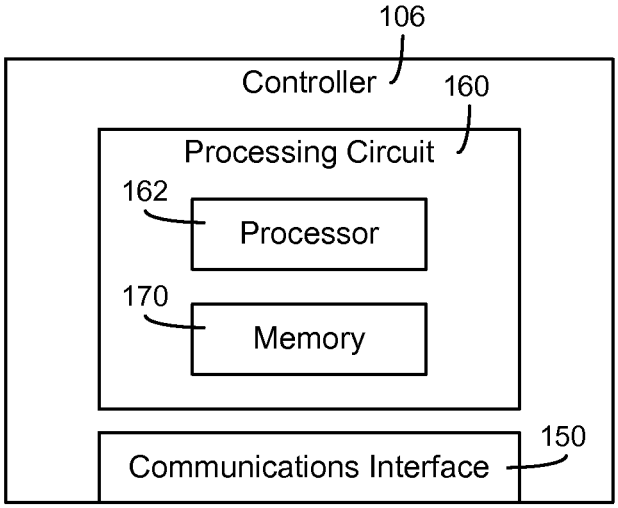
FIG. 6 is a block diagram of a controller configured to control the $CO_2$ refrigeration system and direct $CO_2$ heat exchange subsystems of FIGS. 1-4, according to an exemplary embodiment.

Referring now to FIG. 6, a controller 106 for $CO_2$ refrigeration system 100 is shown, according to an exemplary embodiment. Controller 106 may receive electronic data signals from one or more measurement devices (e.g., pressure sensors, temperature sensors, flow sensors, etc.) located within $CO_2$ refrigeration system 100. Controller 106 may use the input signals to determine appropriate control actions for control devices of $CO_2$ refrigeration system 100 (e.g., compressors, valves, flow diverters, power supplies, etc.).

In some embodiments, controller 106 is configured to operate gas bypass valve 8 and/or parallel compressor 36 to maintain the $CO_2$ pressure within receiving tank 6 at a desired setpoint or within a desired range. In some embodiments, controller 106 operates gas bypass valve 8 and parallel compressor 36 based on the temperature of the $CO_2$ refrigerant at the outlet of gas cooler/condenser 2. In other embodiments, controller 106 operates gas bypass valve 8 and parallel compressor 36 based a flow rate (e.g., mass flow, volume flow, etc.) of $CO_2$ refrigerant through gas bypass valve 8. Controller 106 may use a valve position of gas bypass valve 8 as a proxy for $CO_2$ refrigerant flow rate. In some embodiments, controller 106 operates high pressure valve 4, expansion valves 60, control valves 62, three-way valve 72, control valves 74, and/or control valve 76 as described with reference to FIGS. 2A-3D.

Controller 106 may include feedback control functionality for adaptively operating the various components of $CO_2$ refrigeration system 100. For example, controller 106 may receive a setpoint (e.g., a temperature setpoint, a pressure setpoint, a flow rate setpoint, a power usage setpoint, etc.) and operate one or more components of system 100 to achieve the setpoint. The setpoint may be specified by a user (e.g., via a user input device, a graphical user interface, a local interface, a remote interface, etc.) or automatically determined by controller 106 based on a history of data measurements. In some embodiments, controller 106 includes some or all of the functionality and/or components of the controller described in P.C.T. Patent Application No. PCT/US2014/036131, filed Apr. 30, 2014, the entire disclosure of which is incorporated by reference herein.

Controller 106 may be a proportional-integral (PI) controller, a proportional-integral-derivative (PID) controller, a pattern recognition adaptive controller (PRAC), a model recognition adaptive controller (MRAC), a model predictive controller (MPC), or any other type of controller employing any type of control functionality. In some embodiments, controller 106 is a local controller for $CO_2$ refrigeration system 100. In other embodiments, controller 106 is a supervisory controller for a plurality of controlled subsystems (e.g., a refrigeration system, an AC system, a lighting system, a security system, etc.). For example, controller 106 may be a controller for a comprehensive building management system incorporating $CO_2$ refrigeration system 100. Controller 106 may be implemented locally, remotely, or as part of a cloud-hosted suite of building management applications.

Still referring to FIG. 6, controller 106 is shown to include a communications interface 150 and a processing circuit 160. Communications interface 150 can be or include wired or wireless interfaces (e.g., jacks, antennas, transmitters, receivers, transceivers, wire terminals, etc.) for conducting electronic data communications. For example, communications interface 150 may be used to conduct data communications with gas bypass valve 8, parallel compressor 36, expansion valves 60, control valves 62, high pressure valve 4, various data acquisition devices within $CO_2$ refrigeration system 100 (e.g., temperature sensors, pressure sensors, flow sensors, etc.) and/or other external devices or data sources. Data communications may be conducted via a direct connection (e.g., a wired connection, an ad-hoc wireless connection, etc.) or a network connection (e.g., an Internet connection, a LAN, WAN, or WLAN connection, etc.). For example, communications interface 150 can include an Ethernet card and port for sending and receiving data via an Ethernet-based communications link or network. In another example, communications interface 150 can include a WiFi transceiver or a cellular or mobile phone transceiver for communicating via a wireless communications network.

Processing circuit 160 is shown to include a processor 162 and memory 170. Processor 162 can be implemented as a general purpose processor, an application specific integrated circuit (ASIC), one or more field programmable gate arrays (FPGAs), a group of processing components, a microcontroller, or other suitable electronic processing components. Memory 170 (e.g., memory device, memory unit, storage device, etc.) may be one or more devices (e.g., RAM, ROM, solid state memory, hard disk storage, etc.) for storing data and/or computer code for completing or facilitating the various processes, layers and modules described in the present application. Memory 170 may be or include volatile memory or non-volatile memory. Memory 170 may include database components, object code components, script components, or any other type of information structure for supporting the various activities and information structures described in the present application. According to an exemplary embodiment, memory 170 is communicably connected to processor 162 via processing circuit 160 and includes computer code for executing (e.g., by processing circuit 160 and/or processor 162) one or more processes or control features described herein.

Configuration of Exemplary Embodiments

The construction and arrangement of the $CO_2$ refrigeration system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A $CO_2$ refrigeration system comprising:

a $CO_2$ refrigeration subsystem that provides cooling for a refrigeration load using carbon dioxide ($CO_2$) as a refrigerant;

a direct $CO_2$ heat exchange subsystem that uses the $CO_2$ refrigerant from the $CO_2$ refrigeration subsystem to provide heating or cooling for a building zone, the direct $CO_2$ heat exchange subsystem comprising a heat exchanger that exchanges heat directly between the $CO_2$ refrigerant and an airflow provided to the building zone;

a gas cooler/condenser that cools the $CO_2$ refrigerant and discharges the cooled $CO_2$ refrigerant into a cooled refrigerant line;

wherein the direct $CO_2$ heat exchange subsystem receives the cooled $CO_2$ refrigerant from the cooled refrigerant line and delivers the cooled $CO_2$ refrigerant to the heat exchanger to provide cooling for the building zone;

wherein the direct $CO_2$ heat exchange subsystem further comprises a cooled refrigerant intake line connecting the cooled refrigerant line to the heat exchanger; and an expansion valve located along the cooled refrigerant intake line upstream of the heat exchanger;

a controller configured to operate the expansion valve to control an amount of the cooled $CO_2$ refrigerant provided to the heat exchanger;

a high pressure valve that receives the cooled $CO_2$ refrigerant from the cooled refrigerant line, expands the cooled $CO_2$ refrigerant, and discharges the expanded $CO_2$ refrigerant into an expanded refrigerant line;

wherein the controller monitors a position of the high pressure valve and operates the expansion valve based on the position of the high pressure valve.

2. The $CO_2$ refrigeration system of claim 1, wherein the controller monitors a temperature of the building zone and operates the expansion valve based on the temperature of the building zone.

3. The $CO_2$ refrigeration system of claim 1, wherein the controller determines an amount of superheat of the cooled $CO_2$ refrigerant and operates the expansion valve based on the determined amount of superheat.

4. The $CO_2$ refrigeration system of claim 1, further comprising a high pressure valve that receives the cooled $CO_2$ refrigerant from the cooled refrigerant line, expands the cooled $CO_2$ refrigerant, and discharges the expanded $CO_2$ refrigerant into an expanded refrigerant line;

wherein the direct $CO_2$ heat exchange subsystem comprises a discharge line that receives the $CO_2$ refrigerant from the heat exchanger and discharges the $CO_2$ refrigerant into the expanded refrigerant line.

5. The $CO_2$ refrigeration system of claim 4, wherein the expanded refrigerant line connects the high pressure valve to a receiver that separates the expanded $CO_2$ refrigerant into a liquid $CO_2$ refrigerant and a gas $CO_2$ refrigerant.

6. The $CO_2$ refrigeration system of claim 1, wherein the $CO_2$ refrigeration subsystem comprises a compressor that compresses the $CO_2$ refrigerant to a high temperature high pressure state and discharges the hot compressed refrigerant into a hot compressed refrigerant line;

wherein the direct $CO_2$ heat exchange subsystem receives the hot compressed $CO_2$ refrigerant from the hot compressed refrigerant line and delivers the hot compressed $CO_2$ refrigerant to the heat exchanger to provide heating for the building zone.

7. The $CO_2$ refrigeration system of claim 6, wherein the direct $CO_2$ heat exchange subsystem comprises:

a hot refrigerant intake line that receives the hot compressed $CO_2$ refrigerant from the hot compressed refrigerant line and provides the hot compressed $CO_2$ refrigerant to the heat exchanger; and a hot refrigerant discharge line that receives the $CO_2$ refrigerant from the heat exchanger and provides the $CO_2$ refrigerant to the hot compressed refrigerant line.

8. The $CO_2$ refrigeration system of claim 7, wherein the direct $CO_2$ heat exchange subsystem comprises a control valve operable to control an amount of the hot compressed $CO_2$ refrigerant provided to the heat exchanger.

9. The $CO_2$ refrigeration system of claim 8, wherein the control valve is a three-way valve that receives the hot compressed $CO_2$ refrigerant from the hot refrigerant intake line and directs the hot compressed $CO_2$ refrigerant to either the heat exchanger or the hot refrigerant discharge line based on a position of the control valve.

10. The $CO_2$ refrigeration system of claim 8, further comprising a controller configured to operate the control valve to control an amount of the hot compressed $CO_2$ refrigerant provided to the heat exchanger.

11. The $CO_2$ refrigeration system of claim 10, wherein the controller monitors a temperature of the building zone and operates the control valve based on the temperature of the building zone.

12. The $CO_2$ refrigeration system of claim 10, wherein the controller determines a difference between a temperature of the hot compressed $CO_2$ refrigerant and the temperature of the building zone and operates the control valve based on the difference.

13. A $CO_2$ cooling system for a building, the $CO_2$ cooling system comprising:

a $CO_2$ refrigeration subsystem that provides cooling for a refrigeration load using carbon dioxide ($CO_2$) as a refrigerant;

a gas cooler/condenser that cools the $CO_2$ refrigerant and discharges the cooled $CO_2$ refrigerant into a cooled refrigerant line;

a heat exchanger that receives the cooled $CO_2$ refrigerant from the cooled refrigerant line and exchanges heat directly between the cooled $CO_2$ refrigerant and an airflow provided to the building zone; and a high pressure valve that receives the cooled $CO_2$ refrigerant from the cooled refrigerant line, expands the cooled $CO_2$ refrigerant, and discharges the expanded $CO_2$ refrigerant into an expanded refrigerant line;

wherein the heat exchanger discharges the $CO_2$ refrigerant into the expanded refrigerant line.

14. A $CO_2$ heating system for a building, the $CO_2$ heating system comprising:

a $CO_2$ refrigeration subsystem that provides cooling for a refrigeration load using carbon dioxide ($CO_2$) as a refrigerant;

a compressor that compresses the $CO_2$ refrigerant to a high temperature high pressure state and discharges the hot compressed refrigerant into a hot compressed refrigerant line;

a heat exchanger that receives the hot compressed $CO_2$ refrigerant from the hot compressed refrigerant line and exchanges heat directly between the hot compressed $CO_2$ refrigerant and an airflow provided to the building zone;

a hot refrigerant discharge line that receives the $CO_2$ refrigerant from the heat exchanger and provides the $CO_2$ refrigerant to the hot compressed refrigerant line;

a control valve operable to control an amount of the hot compressed $CO_2$ refrigerant provided to the heat exchanger;

wherein the control valve is a three-way valve that receives the hot compressed $CO_2$ refrigerant from the hot refrigerant intake line and directs the hot compressed $CO_2$ refrigerant to either the heat exchanger or the hot refrigerant discharge line based on a position of the control valve.

15. A $CO_2$ refrigeration system comprising:

a $CO_2$ refrigeration subsystem that provides cooling for a refrigeration load using carbon dioxide ($CO_2$) as a refrigerant;

a direct $CO_2$ heat exchange subsystem that uses the $CO_2$ refrigerant from the $CO_2$ refrigeration subsystem to provide heating or cooling for a building zone, the direct $CO_2$ heat exchange subsystem comprising a heat exchanger that exchanges heat directly between the $CO_2$ refrigerant and an airflow provided to the building zone;

a gas cooler/condenser that cools the $CO_2$ refrigerant and discharges the cooled $CO_2$ refrigerant into a cooled refrigerant line;

a high pressure valve that receives the cooled $CO_2$ refrigerant from the cooled refrigerant line, expands the cooled $CO_2$ refrigerant, and discharges the expanded $CO_2$ refrigerant into an expanded refrigerant line;

wherein the direct $CO_2$ heat exchange subsystem receives the cooled $CO_2$ refrigerant from the cooled refrigerant line and delivers the cooled $CO_2$ refrigerant to the heat exchanger to provide cooling for the building zone; and wherein the direct $CO_2$ heat exchange subsystem includes a discharge line that receives the $CO_2$ refrigerant from the heat exchanger and discharges the $CO_2$ refrigerant into the expanded refrigerant line.

16. The $CO_2$ refrigeration system of claim 15, further comprising a controller configured to operate the expansion valve to control an amount of the cooled $CO_2$ refrigerant provided to the heat exchanger.

17. A $CO_2$ refrigeration system comprising:

a $CO_2$ refrigeration subsystem that provides cooling for a refrigeration load using carbon dioxide ($CO_2$) as a refrigerant;

a direct $CO_2$ heat exchange subsystem that uses the $CO_2$ refrigerant from the $CO_2$ refrigeration subsystem to provide heating or cooling for a building zone, the direct $CO_2$ heat exchange subsystem comprising a heat exchanger that exchanges heat directly between the $CO_2$ refrigerant and an airflow provided to the building zone;

wherein the $CO_2$ refrigeration subsystem comprises a compressor that compresses the $CO_2$ refrigerant to a high temperature high pressure state and discharges the hot compressed refrigerant into a hot compressed refrigerant line;

wherein the direct $CO_2$ heat exchange subsystem receives the hot compressed $CO_2$ refrigerant from the hot compressed refrigerant line and delivers the hot compressed $CO_2$ refrigerant to the heat exchanger to provide heating for the building zone;

wherein the direct $CO_2$ heat exchange subsystem includes a hot refrigerant intake line that receives the hot compressed $CO_2$ refrigerant from the hot compressed refrigerant line and provides the hot compressed $CO_2$ refrigerant to the heat exchanger and a hot refrigerant discharge line that receives the $CO_2$ refrigerant from the heat exchanger and provides the $CO_2$ refrigerant to the hot compressed refrigerant line;

wherein the direct $CO_2$ heat exchange subsystem comprises a three-way control valve that receives the hot compressed $CO_2$ refrigerant from the hot refrigerant intake line and directs the hot compressed $CO_2$ refrigerant to either the heat exchanger or the hot refrigerant discharge line based on a position of the control valve to control an amount of the hot compressed $CO_2$ refrigerant provided to the heat exchanger.

18. The $CO_2$ refrigeration system of claim 17, further comprising a controller configured to operate the control valve to control an amount of the hot compressed $CO_2$ refrigerant provided to the heat exchanger.

19. The $CO_2$ refrigeration system of claim 18, wherein the controller monitors a temperature of the building zone and operates the control valve based on the temperature of the building zone.

* * * * *